US006092020A

United States Patent [19]

Fastenrath et al.

[11] Patent Number: 6,092,020

[45] Date of Patent: Jul. 18, 2000

[54] METHOD AND APPARATUS FOR OBTAINING TRAFFIC SITUATION DATA

[75] Inventors: Ulrich Fastenrath, Düsseldorf; Markus Becker, Essen; Rainer Ogger, Kaarst, all of Germany

[73] Assignee: Mannesmann AG, Düsseldorf, Germany

[21] Appl. No.: 09/117,941

[22] PCT Filed: Jan. 29, 1997

[86] PCT No.: PCT/DE97/00229

§ 371 Date: Aug. 10, 1998

§ 102(e) Date: Aug. 10, 1998

[87] PCT Pub. No.: WO97/29471

PCT Pub. Date: Aug. 14, 1997

[30] Foreign Application Priority Data

Feb. 8, 1996 [DE] Germany ..... 196 06 301

[51] Int. Cl.[7] ..... G08G 1/0967

[52] U.S. Cl. ..... 701/119; 340/992

[58] Field of Search ..... 701/117, 118, 701/119; 340/992

[56] References Cited

U.S. PATENT DOCUMENTS 5,289,183 2/1994 Hassett et al. ..... 340/905

5,539,645 7/1996 Mandhyan et al. ..... 701/119

5,933,100 8/1999 Golding ..... 340/995

*Primary Examiner*—Michael J. Zanelli

*Attorney, Agent, or Firm*—Cohen, Pontani, Lieberman & Pavane

[57] ABSTRACT

A method for obtaining data on the traffic situation in a road network, wherein a plurality of vehicles involved in road traffic ("floating cars") and equipped with sensory analysis equipment for collecting traffic-relevant sensor data, which include at least one variable representing the current speed v(t) of a given vehicle, wirelessly transmit to a center at chronological intervals individual reports concerning the current traffic situation in the vicinity of the given vehicle determined on the basis of collected sensor data by a data processing device arranged in the vehicle. The individual reports, in addition to containing a classifying interpretation of the traffic situation carried out by the data processing device based on the collected speed variables, which interpretation encompasses at least the class of "traffic-related hold-up" (traffic jam), also contain, as part of the report, a confidence factor F, which represents a measure for the waviness of the chronological profile of the speed variables, especially the vehicle speed v(t), for the period of time to which the given individual report relates.

7 Claims, 2 Drawing Sheets

METHOD AND APPARATUS FOR OBTAINING TRAFFIC SITUATION DATA

BACKGROUND OF THE INVENTION

1. Field of the Invention

The invention generally relates to a method for obtaining data on the traffic situation in a road network. More specifically, the invention relates to a method for obtaining data for a plurality of vehicles involved in road traffic and equipped with sensory analysis equipment for collecting traffic-relevant sensor data, which comprise at least one variable representing the current speed v(t) of a given vehicle, for wirelessly transmitting to a center at chronological intervals individual reports concerning the current traffic situation in the vicinity of the given vehicle determined on the basis of collected sensor data by a data processing device arranged in the vehicle. Further, the invention relates to an apparatus in a vehicle for compiling and transmitting such individual reports.

2. Discussion of the Prior Art

Determining and describing the traffic situation is an essential task in the field of traffic telematics, among whose goals is to supply drivers with the most current and helpful information possible, so that the drivers can avoid traffic jams, if possible, and switch to less crowded roads, when needed. The use of stationary collection devices (e.g., beacons, induction loops, etc.) installed at roadside for this purpose is known. However, this entails high costs for creating and maintaining the required infrastructure. It is also disadvantageous that such roadside devices, for system-related reasons, have extremely limited local areas of use, so that a huge number of such devices must be installed to determine the traffic situation in a wide area.

Recently, attempts to determine the traffic situation without using permanently installed roadside devices have also become known, in which information is transmitted from the vehicles of a fleet of sampling vehicles to suitable collection points (e.g., traffic control centers). These vehicles form a sort of measurement station involved in traffic ("floating cars"), and transmit relevant data (in particular, the vehicle speed) via mobile wireless communications devices (e.g., mobile phones) to a data collection point for further processing and evaluation. The results of this evaluation can then be sent to a large number of drivers in the form of driving instructions and recommended detours, so that the drivers can make good decisions about the route to take depending on the traffic situation. The results can also be entered into automatic route planning and guidance systems.

One problem of "floating cars" is that the continuous transmission of the current speed of a large number of vehicles places an extraordinarily heavy load on the transmission channels of the communications devices used, and also constitutes a significant cost factor in using a fee-based communications system. For this reason, an attempt is made to transmit compressed data, if possible, rather than individual measurement values, to the center where the traffic information is collected and processed for the end user. For example, the average speed of a given vehicle could be transmitted to the center at chronological intervals. However, this is still very expensive. It would be much more effective if a decision as to whether particular data are of greater or lesser importance to the traffic situation could be made in the vehicle in which suitable sensory analysis equipment carries out the actual data collection, and data transmission could be limited to important data only. In this respect, it would be of great interest, for example, if the transmission could be limited solely to information concerning detected traffic congestion.

In general, regarding systems for obtaining traffic information based on "floating cars," a large number of reports are automatically produced about events that are unusual and therefore significant from the point of view of the "floating cars." These reports must first be checked thoroughly before flowing into traffic services such as route planning, vehicle guidance, traffic planning and traffic processes. Given the sensory analysis equipment in the "floating cars," which, for reasons of cost, is kept as simple as possible, there would inevitably be misidentifications of various types of events based on a mechanical analysis of the collected sensor data. An especially drastic example of this would be mistaking the event "stopping at rest area" for the event "traffic jam" during an automobile trip. In both cases, the sensory analysis equipment would detect a vehicle speed of zero. In view of the large number of reported events in a traffic information system based on "floating cars," the economic feasibility of such a system, if there is a purely manual solution of the problem of checking and, if needed, correcting event reports that reach the center, is questionable from the start.

SUMMARY OF THE INVENTION

The object of the invention is therefore to further provide a method by which event reports can be checked with adequate reliability at the center using a method that can be, at least to a great extent, automated. Further, the invention also provides an apparatus in a vehicle that can be used to collect and transmit traffic situation data in the framework of the method according to the invention.

The invention attains its object in a generic method since the individual reports transmitted to the center from the "floating cars" are composed in a certain way. First of all, each report includes a classifying interpretation of the traffic situation that exists in the vicinity of the vehicle, which interpretation is provided, on the basis of the collected speed variables, by the data processing device carried in the particular vehicle. Furthermore, each report also contains a confidence factor F, which is derived by the data processing device from the collected speed variables. This confidence factor F represents a measurement of the waviness of the chronological profile of the collected speed variables for the time period to which the given report relates. The speed variables are preferably the current speeds v(t) of the vehicle. Of course, it is also easy to use other variables of equal informational value for this purpose. For example, the time needed to travel a predetermined section of the route, or the distance travelled in a predetermined period of time, can be found and transmitted. The waviness of the speed variable profile refers to a comparison variable that represents information on the "intensity" of the chronological fluctuations of the given speed variable. A series of approaches can be used for this purpose. Preferably, the confidence factor F is arrived at as follows:

The approximate length of the graph v(t) (i.e., the current speed of the given "floating car" over the time period to which the individual report relates) is calculated. Then, the length of the graph v(t) is normed utilizing a predetermined reference speed and the measurement frequency f used in collecting the sensor data (i.e., finding the speed variables). In principle, any desired speed value can be used as the reference speed. However, it is advisable to use the minimum vehicle speed $v_{min}$, which also serves as the threshold value for identifying traffic-related hold-ups (traffic jams).

This means that the data processing device in a "floating car" presumes a traffic-related traffic jam only if the sensory analysis equipment finds a vehicle speed v(t) that is smaller than or equal to the predetermined threshold value $v_{min}$. In a preferred embodiment of the invention, this reference speed is changed by the center as needed and then transmitted wirelessly to the individual "floating cars." In this way, the sensitivity of the process can be deliberately adjusted. This can be advantageous, for example, in meeting the requirements of an interstate highway, where speeds are usually higher, as compared to an urban highway in a congested area with correspondingly lower speeds. In practical tests, it has proved particularly advantageous to form the confidence factor F in accordance with the following equation:

$$F = \frac{f}{N-1} \sum_{i,i+1 \in S} \frac{\min(Vmin|V(ti+1) - V(ti)|)}{Vmin}(ti+1-ti)$$

where:

S=Index quantity of speed measurements in course of sensor data collection (preferably, index quantity assigned to a traffic jam event)

N=Cardinal number of index quantity $t_i$=Times at which speed measurements were carried out.

With respect to the apparatus for transmitting individual reports for the purpose of traffic situation determination, it includes sensory analysis equipment for collecting data, which comprise representative data (speed variables) for at least the current vehicle speed, as well as a data processing device connected to the sensory analysis equipment. Further, this apparatus comprises a communications device for the wireless transmission to a center of individual reports characteristic of the actual traffic situation in the vicinity of the vehicle.

Based on the collected speed variables, the data processing device carries out a classifying interpretation of the traffic situation in the area of the vehicle. This interpretation encompasses at least the class of "traffic-related hold-up (traffic jam)." Further, based on the collected speed variables, the data process device forms a confidence factor F, which represents a measure of the waviness of the chronological profile of the speed variables for the period of time to which the individual report relates, i.e., in particular, for the time interval for passing through a traffic jam. Finally, the data processing device summarizes the individual reports to be transmitted to the center via the communications device in such a way that each report encompasses at least the classifying interpretation of the traffic situation in the vicinity of the vehicle and the confidence factor F.

BRIEF DESCRIPTION OF THE DRAWINGS

In the drawings, wherein like reference characters denote similar elements throughout the several views.

DETAILED DESCRIPTION OF THE PREFERRED EMBODIMENTS

Figure 1:
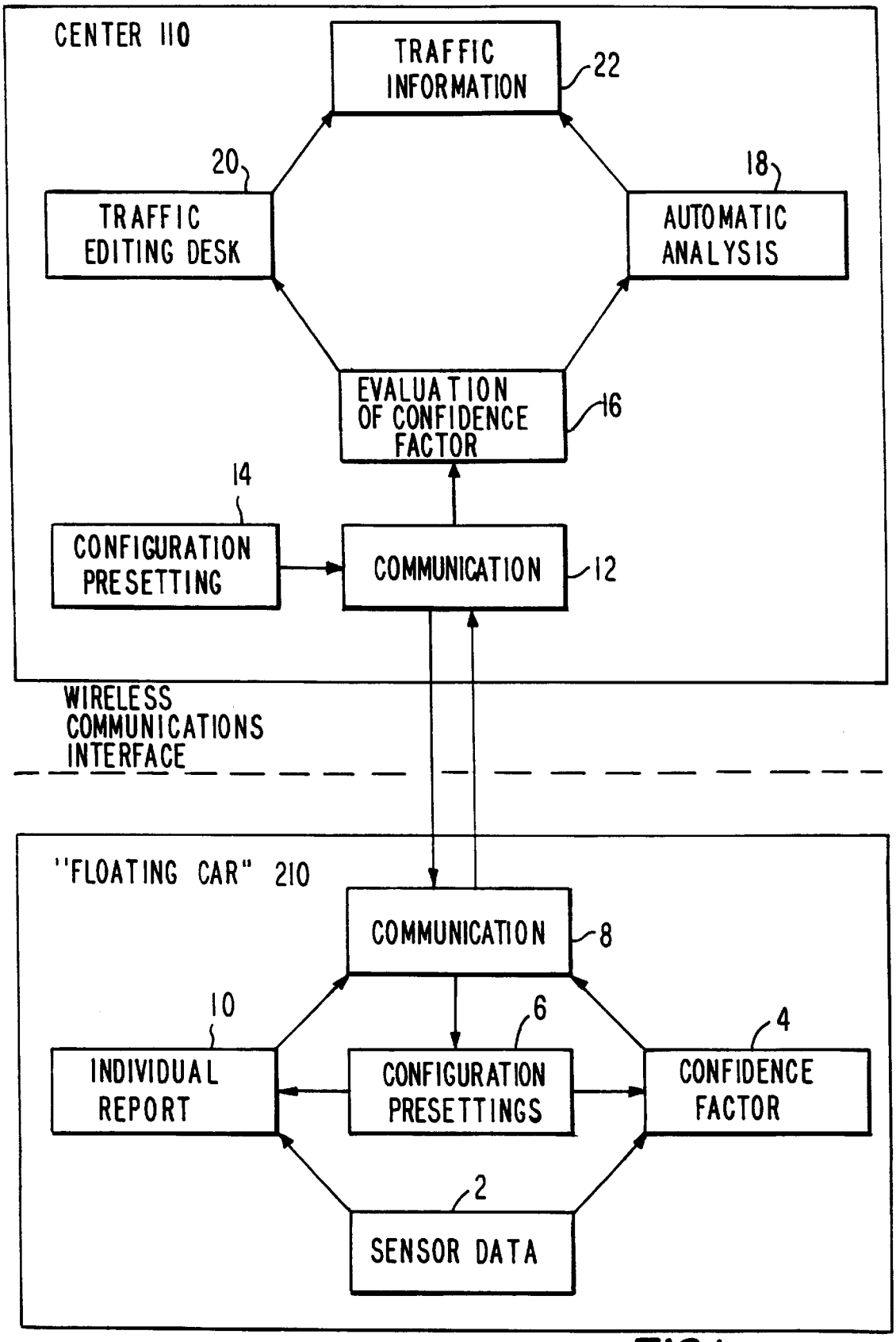
FIG. 1 is a diagram of a traffic situation determination system.

With reference to the figures, FIG. 1 is a diagram of a traffic situation determination system which is divided into functional blocks belonging to a center 110 for collecting traffic situation data and functional blocks belonging to individual "floating cars 210." The starting point is the collection of sensor data 2 by using suitable sensory analysis equipment in each "floating car." From these sensor data 2, which preferably comprise the current speed of the given vehicle, the data processing device connected to the sensory analysis equipment in the "floating car" determines a confidence factor F4, preferably in accordance with the above formula.

The data processing device of the "floating car" can thereby measure the necessary values for the reference speed $v_{min}$ and, if needed, the duration of the measurement interval and the measurement frequency f from a memory device. These are identified in FIG. 1 as "configuration presettings 6." The presettings 6 can be changed as needed via a transmitter/receiver ("communications") 8 provided for wireless data exchange with the center. Based on the speed variables collected via the sensory analysis equipment, the data processing device in the "floating car" carries out, pursuant to the present invention, a classifying interpretation of the traffic situation in the vicinity of the vehicle and also determines the confidence factor F4 for this interpretation. The interpretations of the traffic situation, in particular, the traffic jam reports belonging to the class of "traffic-related hold-up," are transmitted to the center in the form of individual reports 10, together with the determined confidence factor 4 in each case, via the "communications" 8 functional block. The transmitter/receiver of the center, which is also symbolized by a function block entitled "communications," 14 receives and stores the transmitted individual reports. As needed, a data set to change the preset values in the "floating" cars can be taken from the "configuration presettings" 14 functional block of the center. The data processing device in the center, which will not be described in greater detail, checks every individual incoming report to determine, based on the accompanying confidence factor, whether the interpretation of the traffic situation provided by the "floating car" is probably correct or only doubtful. This relates to the evaluation of the confidence factor 16 functional block. As mentioned, the speed of a vehicle can equal zero not only in a traffic jam caused by heavy traffic (traffic-related hold-up), but also in the case of a planned stop at a roadside restaurant or rest area on an autobahn or highway. As a rule, a traffic jam created by heavy traffic can be identified by characteristic fluctuations in the speed profile. In contrast, in the case of a planned stop at a restaurant or rest area, there is usually a relatively smooth speed profile immediately before the stop occurs. However, it is also possible for a sudden traffic jam to occur as the result of an accident followed by a total stop of road traffic; in this case, too, a relatively smooth speed profile will exist before the zero point is reached. In the event of a traffic-related hold-up, the method of the present invention would find a comparatively large confidence factor F (near the maximum value 1). On the other hand, in the case of the aforementioned planned stop at a roadside rest area or in the event of a sudden stop due to accident, a relatively low confidence factor F would exist. According to the invention, therefore, for the large number of individual reports coming into the center, the data processing device of the center automatically evaluates the individual reports based on the confidence factor. (See evaluation of confidence factor 16 functional block). All individual reports with a confidence factor above a threshold value of 0.4, for example, are accepted as correctly interpreted (automatic analysis 18), while all individual reports with a lower confidence factor are sent to a traffic editor for manual evaluation. From the two partial streams of automatically analyzed individual reports (i.e. Automatic Analysis 18 functional block) and individual reports revised or finally evaluated by a traffic editor (the traffic editing desk 20), the traffic information that can be provided to drivers is formed in the center.

The present invention permits a high reliability of the informative value of traffic information 22. A largely automatic evaluation of the collected individual information thereby takes place. Manual evaluation is necessary only for a considerably smaller portion of the collected individual reports to guarantee reliable input data for the traffic information to be derived. This ensures the economical feasibility of a high-quality data collection.

Figure 2:
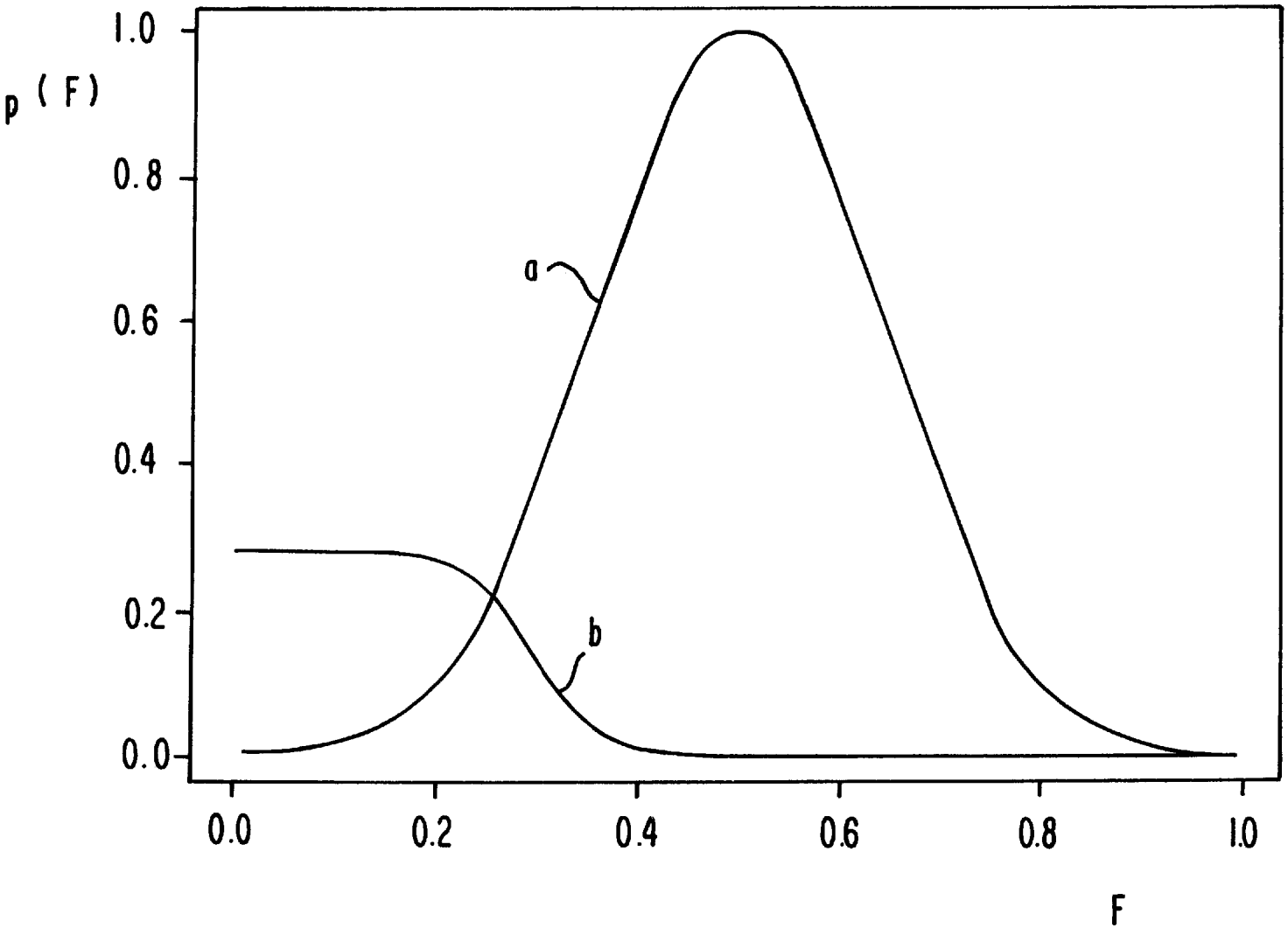
FIG. 2 is a frequency distribution of true and false traffic jam reports as a function of the confidence factor F.

Referring to FIG. 2, this shows the efficiency of the method according to the invention in schematic fashion, i.e., not-to-scale and based on frequency distributions. For a large number of individual reports, the individual confidence factors of which were determined using the above formula, the frequency distributions p(F) are plotted as a function of the confidence factor F. Curve a represents the individual reports in which the automatic evaluation of "traffic-related hold-up" was actually correct. On the other hand, Curve b shows the frequency distribution of individual reports incorrectly interpreted as traffic jam reports by the automatic evaluation system in the "floating cars." As FIG. 2 shows, individual traffic jam reports with a confidence factor F of approximately 0.4 or higher have an extraordinarily high reliability, since only very few individual reports with a higher confidence factor F were incorrectly placed into this category. While there have shown and described and pointed out fundamental novel features of the invention as applied to several preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

What is claimed is:

1. A method for obtaining data on a traffic situation in a road network wherein a plurality of vehicles involved in road traffic known as "floating cars" are equipped with sensory analysis equipment for collecting traffic-relevant sensor data to be transmitted to a central station, the method comprising the steps of:

collecting the traffic-relevant sensor data including a speed variable using a data processing device located in each of the plurality of vehicles wherein the speed variable represents current speed v(t) of each one of said plurality of vehicles for a period of time;

determining a classifying interpretation of the traffic situation based on the collected speed variables;

determining a confidence factor F which represents a measurement for a waviness of a chronological profile of the speed variable; and wirelessly transmitting to the central station at chronological intervals, a plurality of individual reports which includes the classifying interpretation of the traffic situation and the confidence factor F.

2. The method according to claim 1 wherein the classifying interpretation of the traffic situation encompasses at least a class of a traffic jam.

3. The method according to claim 1, wherein the step of determining a confidence factor includes calculating an approximate length of a graph v(t) over the time period to which each one of the plurality of individual reports relates and norming the length of the graph v(t) using a predetermined reference speed and a measurement frequency f.

4. The method according to claim 3, wherein the reference speed is a preestablished minimum vehicle speed, $v_{min}$ which is a threshold value for identifying a traffic jam.

5. The method according to claim 4, wherein the step of determining the confidence factor F includes determining the confidence factor in accordance with the following equation $$F = \frac{f}{N-1} \sum_{i,i+1 \in S} \frac{\min(v_{\min} | v(t_{i+1}) - v(t_i)|)}{v_{\min}} (t_{i+1} - t_i)$$

S=Index quantity of speed measurements in course of sensor data collection (preferably, index quantity assigned to a traffic jam event)

N=Cardinal number of index quantity $t_i$=Times at which speed measurements were carried out.

6. The method according to claim 3, further comprising the step of wirelessly transmitting the predetermined reference speed to the central station.

7. An apparatus in a vehicle for collecting and transmitting traffic situation data in a plurality of individual reports to a central station, comprising:

sensory analysis means for collecting the traffic situation data at least representative of a vehicle speed variable;

data processing means connected to the sensory analysis means for providing a confidence factor F based on the collected speed variable and a classifying interpretation of a traffic situation in a vicinity of the vehicle, the classifying interpretation encompassing at least a traffic jam wherein the confidence factor F represents a measurement for a waviness of a chronological profile of the speed variable for a time period to which a given individual report relates; and communications means for wirelessly transmitting the individual reports to the central station, the individual reports including at least the confidence factor F and the classifying interpretation of the traffic situation.

* * * * *